US005857866A

United States Patent [19]

Felps

[11] Patent Number: 5,857,866

[45] Date of Patent: Jan. 12, 1999

[54] SUPPLEMENTAL ELECTRICAL CONNECTOR FOR MATING CONNECTOR PAIR

[75] Inventor: Jimmie D. Felps, Colorado Springs, Colo.

[73] Assignee: Hewlett-Packard Company, Palo Alto, Calif.

[21] Appl. No.: 818,487

[22] Filed: Mar. 14, 1997

Related U.S. Application Data

[63] Continuation-in-part of Ser. No. 699,023, Aug. 16, 1996.

[51] Int. Cl.[6] ..... H01R 13/28

[52] U.S. Cl. ..... 439/289; 439/953

[58] Field of Search ..... 439/289, 314, 439/319, 700, 824, 953

[56] References Cited

U.S. PATENT DOCUMENTS

| | | | |
|---|---|---|---|
| 2,369,860 | 2/1945 | Schroeder | 439/289 |
| 3,994,552 | 11/1976 | Selvin | 439/289 |
| 4,083,619 | 4/1978 | McCormick et al. | 439/953 |
| 4,423,373 | 12/1983 | LeCroy, Jr. | 324/72.5 |
| 4,672,306 | 6/1987 | Thong | 324/72.5 |
| 4,708,661 | 11/1987 | Morland et al. | 439/77 |
| 4,734,050 | 3/1988 | Negne et al. | 439/289 |
| 5,015,947 | 5/1991 | Chism | 324/158 P |
| 5,293,122 | 3/1994 | Cake et al. | 324/158 P |
| 5,431,580 | 7/1995 | Tabata | 439/289 |
| 5,460,536 | 10/1995 | Cullen | 439/289 |

OTHER PUBLICATIONS

Tajimi BNCS series, "One Touch Push/Pull Locking BNC Coaxial RF Connector (50 Ω/75 Ω) /BNCS series" (undated).

Tajimi Electronics Co., Ltd., Data Sheet for DNCS502–P ().

Stonewells Corporation, Data Sheet for BNCS502–P() (undated).

$1^2$ C Bus specification, Dec., 1988.

*Primary Examiner*—Hien Vu

[57] ABSTRACT

Accordingly, a supplemental electrical connector assembly for transmitting at least one supplemental electrical signal to a supplemental contact pad associated with a mating electrical connector pair may comprise a pin block mounted to a first connector portion of the mating electrical connector pair. A pogo pin assembly having a connector pin positioned at one end and a contact pin positioned at the other end is mounted to the pin block so that the contact pin extends from the front end of the pin block and so that the connector pin extends from the rear end of the pin block. A printed wiring board attached to the first connector portion of the mating electrical connector pair engages the connector pin on the pogo pin assembly.

20 Claims, 8 Drawing Sheets

SUPPLEMENTAL ELECTRICAL CONNECTOR FOR MATING CONNECTOR PAIR

CROSS-REFERENCE TO RELATED APPLICATION

This is a continuation-in-part of co-pending U.S. patent application Ser. No. 08/699,023, filed on Aug. 16, 1996.

FIELD OF INVENTION

This invention relates generally to the field of electrical connectors and more specifically to BNC connectors.

BACKGROUND

Various kinds of electrical connectors exist and have been used for decades to provide a removable electrical connection between various types of electrical components and devices. One such kind of removable electrical connector is known as a BNC or Bayonet Neil-Concelman connector. BNC connectors were developed many years ago and are typically used to connect coaxial (i.e., two conductor) cables, frequently in low-power, radio-frequency, and test applications, although they may be used in other applications as well.

Referring to FIG. 1, a typical BNC connector may comprise a female connector assembly 11 and a male connector assembly 13 that are designed to be engaged and disengaged with one another. The connectors are two-conductor connectors, with one of the conductors being a center conductor 23 (which mates with a female receptacle 21), and the other conductor being a center terminal 33 (which mates with a sleeve 15). In many applications, the second conductor, i.e., the center terminal 33 and sleeve 15, are grounded, although that is not necessary. The sleeve 15 of the female connector assembly 11 surrounds the female receptacle 21 and includes a pair of diametrically opposed engagement pins 17, 19 that extend radially outward from the sleeve 15. The male connector assembly 13 includes a male BNC center terminal 33 having a center conductor 23. The male connector assembly 13 also includes a locking collar 29 having a pair of slots 25, 27 that are adapted to engage the engagement pins 17, 19 on the sleeve 15 of the female connector 11 to lock the connectors 11 and 13 together.

The female and male connectors 11 and 13 can be connected and locked together by first engaging the male BNC center terminal 33 with the sleeve 15 and then rotating the locking collar 29 to the locked position. This twist-lock coupling action is a central feature of the BNC connector and allows a reliable electrical connection to be made without the danger of the female and male connectors 11 and 13 gradually working loose or becoming accidently unplugged.

While such twist-lock BNC connectors provide a convenient and reliable means for electrically connecting various electronic components and devices, they are not without their disadvantages. For example, in a conventional twist-lock BNC connector, sufficient space must be associated with the connector installation to allow the user's thumb and forefinger to push-on the male connector (e.g., 13) and then twist the locking collar (e.g., 29) to the locked position. If the BNC connector is aged or dirty, excessive friction between the locking collar and the body of the male center terminal (e.g., 33) or the sleeve (e.g., 15) of the female connector (e.g., 11) may make it difficult to twist the locking collar to the locked position, particularly if other connectors or components are located nearby. Another problem is that there is no guaranteed radial alignment between the locking collar and the cable (e.g., 31) or probe housing to which it is attached. That is, since the collar on the male connector portion is free to rotate 360°, no specific rotational alignment is guaranteed between the cable or probe housing and the panel to which it is attached. This can be a problem if the male BNC connector is associated with an "active" probe assembly having associated with it supplemental connectors (e.g., power or communication connectors) that need to be aligned with corresponding mating connectors adjacent the female BNC connector.

Another problem that is associated with BNC connectors used with "active" probe assemblies is that the housing or pod used to house the probe electronics is typically located at the end of the probe cable. Therefore, it is usually desirable to minimize the size of the housing or probe pod to maximize the number of probes that may be connected to the particular instrument without physical interference between adjacent probe housings. It is also generally desirable to reduce or eliminate the amount of hand soldering required to fabricate the active probe assemblies and provide supplemental connectors therefor.

Consequently, a need exists for an improved connector which solves or at least ameliorates some of the problems associated with conventional twist-lock BNC connectors, but that retains the advantages associated with such connectors. Ideally, such an improved connector should retain the ability to be locked to the female portion of the connector, but without requiring excessive manual dexterity on the part of the user and without requiring a large amount of space between the BNC connector and adjacent connectors or components. Additional utility could be achieved if the improved BNC connector could be used with conventional female BNC connectors. Still other advantages could be realized if such an improved connector would provide for a guaranteed radial alignment between the panel and the attached cable or pod housing.

A need also exists for an improved supplemental connector for providing supplemental electrical connections across a union between a mating connector pair. Such an improved supplemental connector should be compact to minimize the size of the probe pod housing and should minimize or eliminate the need for hand soldering to connect the active probe electronics to the supplemental connectors.

SUMMARY OF THE INVENTION

Accordingly, a supplemental electrical connector assembly for transmitting at least one supplemental electrical signal to a supplemental contact pad associated with a mating electrical connector pair may comprise a pin block mounted to a first connector portion of the mating electrical connector pair. A pogo pin assembly having a connector pin positioned at one end and a contact pin positioned at the other end is mounted to the pin block so that the contact pin extends from the front end of the pin block and so that the connector pin extends from the rear end of the pin block. A printed wiring board attached to the first connector portion of the mating electrical connector pair engages the connector pin on the pogo pin assembly.

BRIEF DESCRIPTION OF THE DRAWING

Illustrative and presently preferred embodiments of the invention are shown in the accompanying drawing in which.

DETAILED DESCRIPTION OF THE INVENTION

Figure 1:
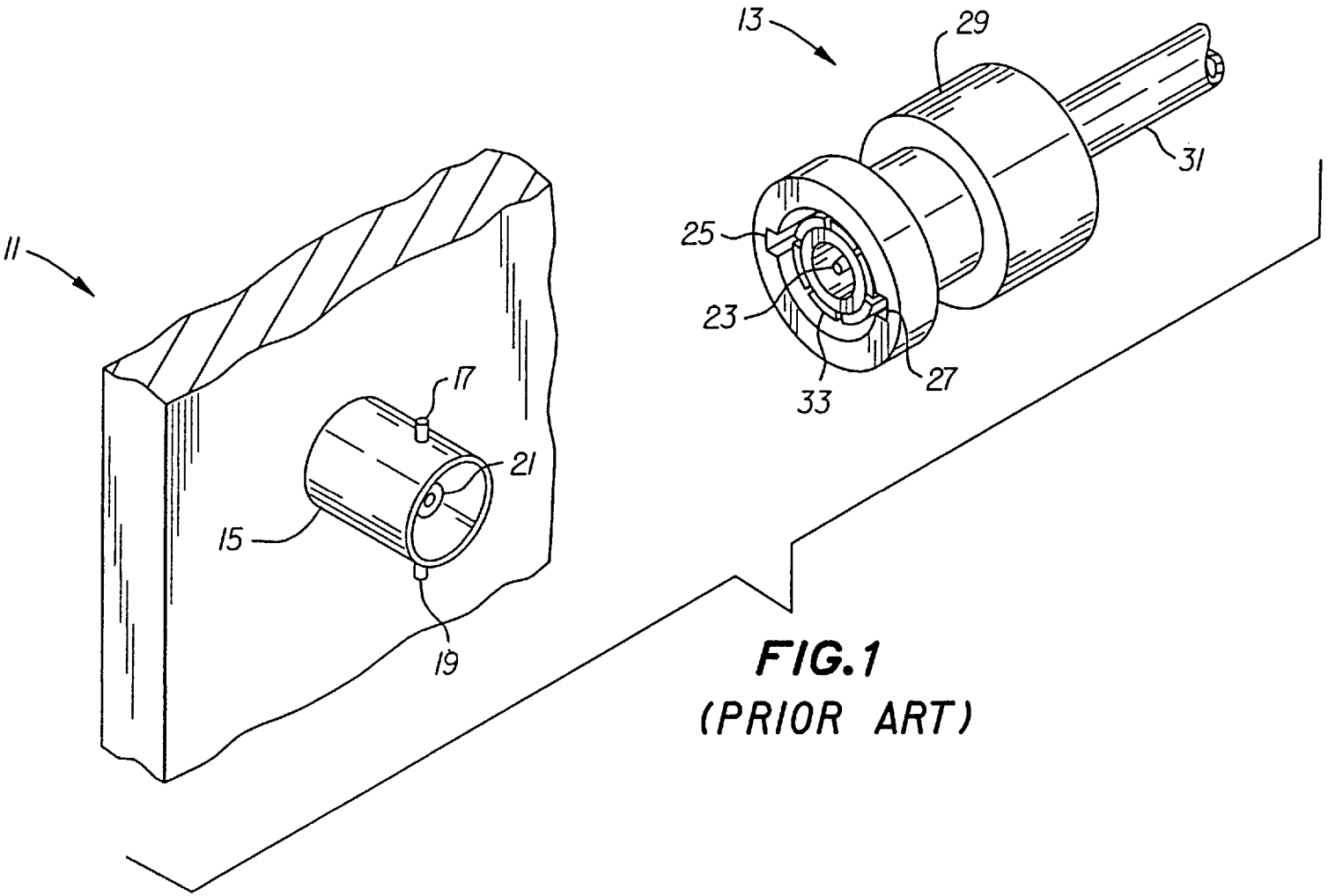
FIG. 1 (PRIOR ART)
FIG. 1 is a perspective view of a conventional male and female BNC connector pair.
Figure 2:
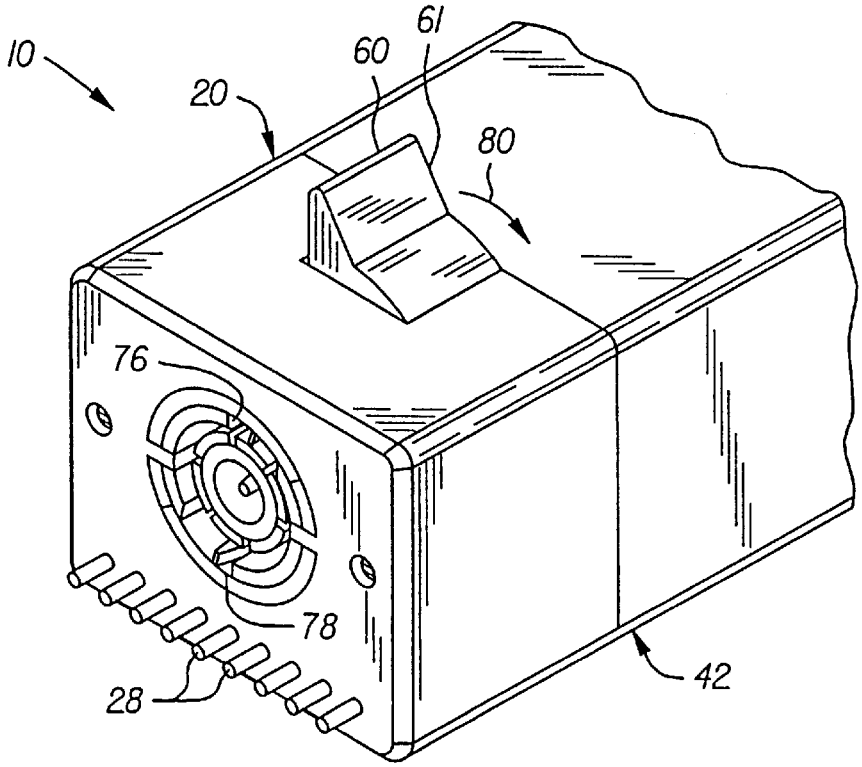
FIG. 2 is a perspective view of a male push-lock BNC connector according to the present invention having a plurality of optional contact pins for transmitting supplemental electrical currents or signals through the connector.
Figure 3:
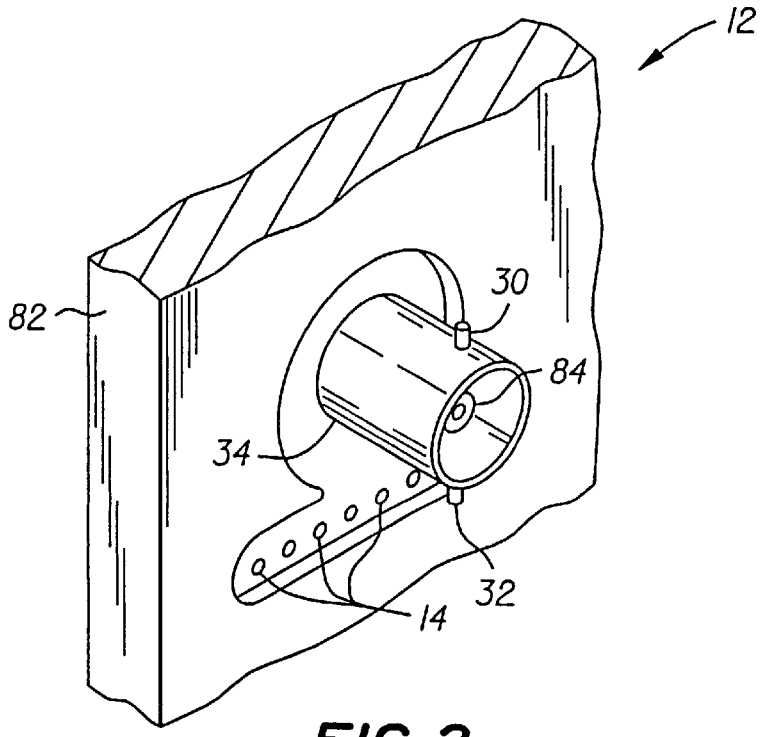
FIG. 3 is a perspective view of a female BNC connector assembly also having a plurality of optional contact pads for transmitting supplemental electrical currents or signals through the connector.
Figure 4:
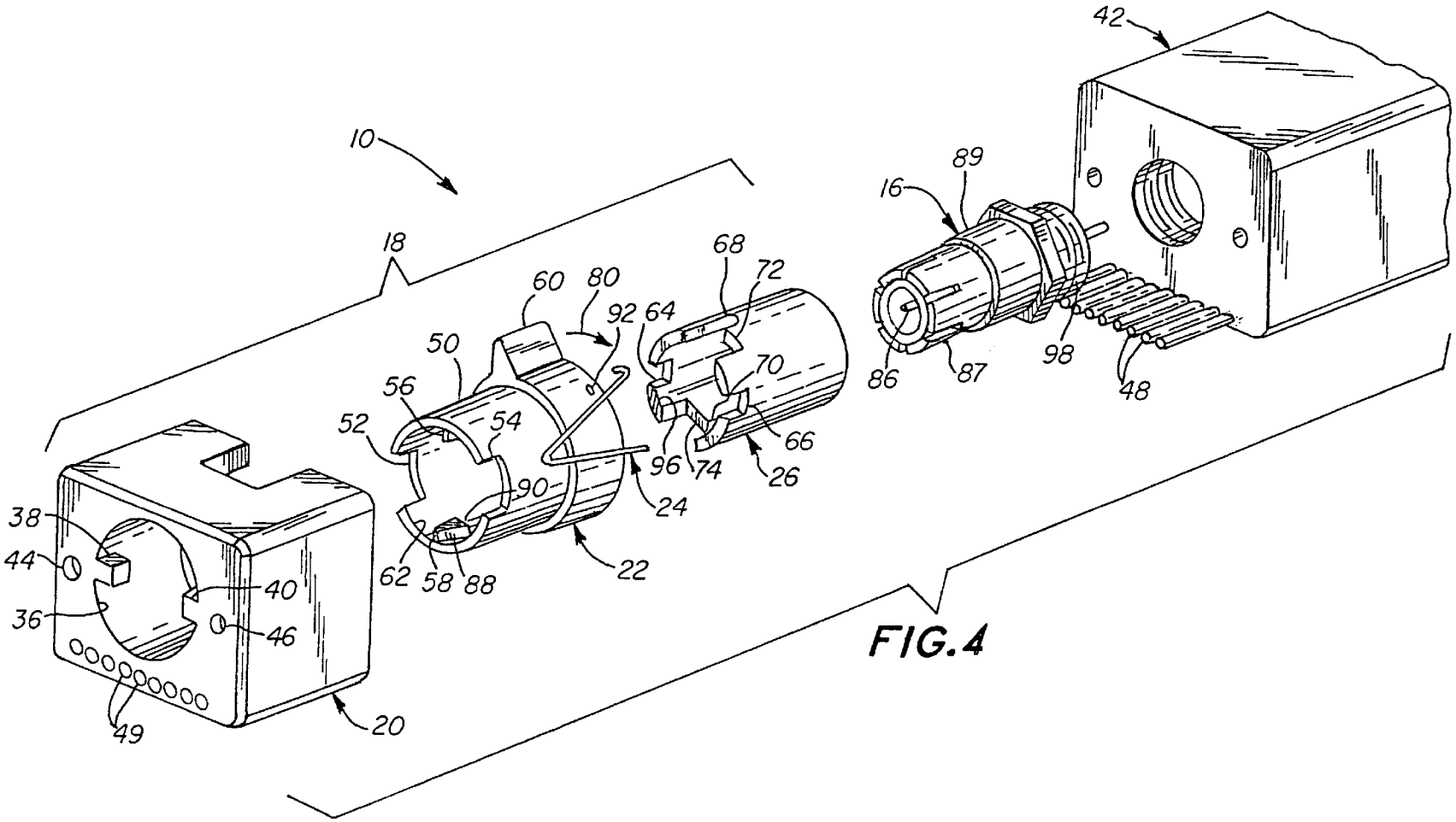
FIG. 4 is an exploded perspective view of the male push-lock BNC connector shown in FIG. 2 more clearly showing the arrangement of the locking sleeve, the alignment sleeve, and the male BNC center terminal.

A push-lock BNC connector 10 according to the present invention is best seen in FIGS. 2 and 4 as it could be used to connect with a female BNC connector portion 12 shown in FIG. 3. In one preferred embodiment, the push-lock BNC connector 10 includes a plurality of contact pins 28 for making electrical contact with a plurality of corresponding contact pads 14 positioned adjacent the female BNC connector 12. The pins 28 and contact pads 14 allow for the transmission of supplemental electrical signals through the connector union, such as may be required for "active" probe assemblies, i.e., probe assemblies having on-board electronic circuitry. Alternatively, and as will be described in greater detail below, the push-lock BNC connector 10 could also be used to connect with a conventional female BNC connector without such optional contact pads 14, such as the female BNC connector 11 shown in FIG. 1.

Referring now specifically to FIG. 4, the push-lock BNC connector 10 essentially comprises a male BNC center terminal or connector portion 16 and a locking assembly 18 which allows the male BNC center terminal 16 to be engaged with and locked to the female BNC connector 12 (FIG. 3) by simply pushing the push-lock connector 10 onto the female connector 12. There is no need to rotate any locking collar to engage the locking pins 30, 32 on the sleeve 34 of female connector 12. The connectors 10 and 12 can be uncoupled by simply moving the tab 60 on the locking collar 22 to the unlocked position 61' (FIG. 6) i.e., in the direction of arrow 80.

The locking assembly 18 in one preferred embodiment may comprise a housing 20, a locking sleeve 22, a spring 24, and an alignment sleeve 26. The housing 20 has a central aperture 36 therethrough as well as a pair of alignment tabs 38, 40 for engaging corresponding slots 64, 66 on the alignment sleeve 26. The housing 20 may be secured to a main connector body 42 of an active probe assembly (not shown) by any convenient means, such as by a pair of screws (not shown) through holes 44, 46. The housing 20 may also include a plurality of holes 49 for receiving a corresponding plurality of connector pin sockets 48 mounted to the main connector body 42.

Figure 6:
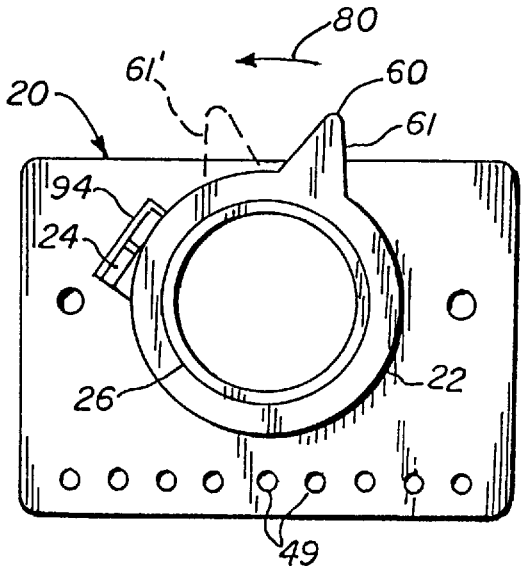
FIG. 6 is a rear view in elevation of the housing showing the arrangement of the locking sleeve and spring.

The locking collar 22 is sized to be received by the central aperture 36 of housing 20 so that the locking collar 22 can be rotated within the housing 20 between a locked position 61 and an unlocked position 61', as best seen in FIG. 6. In one embodiment, the locking collar 22 includes an elongate, cylindrically shaped body portion 50 having a pair of substantially diametrically opposed slots 52, 54, along with a pair of locking pin engaging bosses 56, 58. Locking collar 22 may also include an integral tab 60 to allow the user to rotate the locking collar 22 to the unlocked position 61' by moving the tab 60 in the direction of arrow 80. A spring 24 connected to the locking collar 22 biases the locking collar 22 to the locked position 61.

Locking assembly 18 also includes an alignment sleeve 26 sized to be received by the central aperture 62 of the locking sleeve 22. The alignment sleeve 26 includes a pair of substantially diametrically opposed slots 64 and 66 for engaging the respective alignment tabs 38 and 40 of the housing 20. It also includes a pair of indexing slots 68 and 70 for receiving the locking pins 30 and 32 located on the sleeve 34 of female connector portion 12 (FIG. 3). Indexing slots 68 and 70 also include a pair of clearance slots 72 and 74 to provide clearance for the respective locking pin engaging bosses 56, 58 on the locking sleeve 22. The alignment sleeve 26 is also sized to slide over the male BNC center terminal 16, which itself may be secured to the main connector body 42 by any convenient means, such as by screw threads 98.

Figure 7:
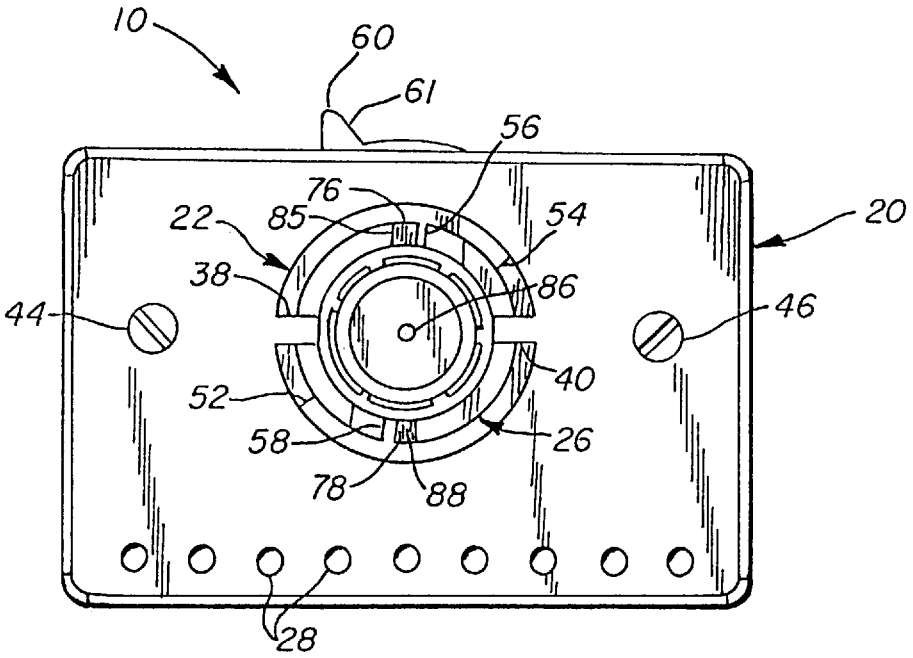
FIG. 7 is a front view in elevation of the housing showing the arrangement of the locking sleeve and alignment sleeve.

The locking assembly 18 thus provides a means for lockably engaging the male BNC center terminal 16 to a conventional female BNC connector, such as the female connector portion 12 shown in FIG. 3. The engagement procedure is relatively simple, requiring only that the push-lock BNC connector assembly 10 be aligned with the sleeve 34 of the female connector portion 12. More specifically, the connectors should be aligned so that the locking pins 30 and 32 are aligned with the engagement slots 76, 78 (FIGS. 2 and 7) defined between indexing slots 68, 70 of the alignment sleeve 26 and the locking pin engaging bosses 56, 58. The connectors can then be engaged by simply pushing the connector 10 over the female connector 12. As the connector 10 moves along the sleeve 34 of the female connector 12, the locking pins 30, 32 engage the bosses 56, 58, which cause the locking sleeve 22 to rotate to the unlocked position 61' (FIG. 6). Once the connector 10 is fully engaged, the spring 24 returns the locking sleeve 22 to the locked position 61.

The connector assembly 10 is then in locked engagement with the female connector portion 12.

The push-lock BNC connector can be disengaged by simply moving the tab 60 in the direction of arrow 80 which rotates the locking sleeve 22 to the unlocked position 61' (FIG. 6) and disengages the bosses 56 and 58 from the locking pins 30, 32. The connector 10 may then be withdrawn from the female connector portion 12.

As was mentioned above, the push-lock BNC connector may be provided a plurality of contact pins, such as pins 28 (FIG. 2), for making electrical contact with a plurality of corresponding contact pads 14 positioned adjacent the female BNC connector 12 (FIG. 3). The pins 28 and contact pads 14 allow for the transmission of supplemental electrical signals across the connector union, such as may be required for "active" probe assemblies, i.e., probe assemblies having on-board electronic circuitry.

Referring now to FIGS. 10–14, a supplemental electrical connector assembly 235 is shown as it could be incorporated into a push-lock BNC connector 210 of the type described above. Essentially, the supplemental electrical connector assembly 235 comprises a pin block 237 for holding one or more pogo pin assemblies 228. The tip portion 239 of each pogo pin assembly 228 contacts a corresponding pad (e.g., 14) that is located adjacent the mating or female BNC connector portion (e.g., 12) when the two connector portions are engaged. See FIG. 3. A connector pin 241 on the pogo pin assembly 228 mates with a female connector 253 on printed wiring board 245, thereby electrically connecting the appropriate circuit node (not shown) on printed wiring board 245 with the pogo pin assembly 228, thus the supplemental contact pad (e.g., 14, FIG. 3) located adjacent mating connector (e.g., 12, FIG. 3).

In one preferred embodiment, the various pogo pins 228 are arranged along a line 291 that is generally perpendicular to an axis 293 that contains the opposed slots 276, 278 that receive the engagement pins 30, 32 on the female connector assembly 12 (FIG. 3). Such an arrangement minimizes the tendency for the spring-biased pogo pins 228 to tilt or cock the connector 210 on the female connector assembly 12 when the two connectors are engaged. That is, the force F exerted on the connector body 220 by the various pogo pin assemblies 228 can be more effectively resisted by the engagement pins 30, 32 on the female connector assembly 12. Also, it is also preferred, but not required, that approximately the same number of pogo pin assemblies 228 be located on either side of the axis 293, again to minimize the tendency for the pogo pins 228 to tilt or cock the connector 210 when it is engaged with the female connector assembly 12.

Figure 13:
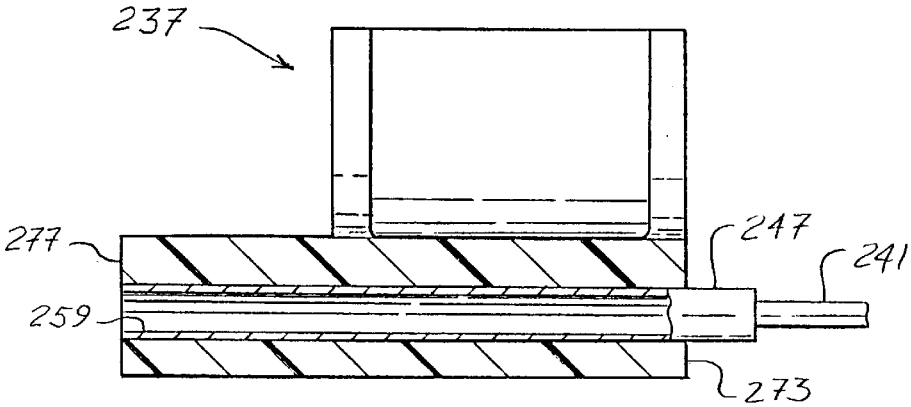
FIG. 13 is a cross-section view in elevation of the pin block showing the position of the socket and connector pin therein.

In one embodiment, each pogo pin assembly 228 is sized to be slidably received by an electrically conductive socket portion 247 that is mounted within the pin block 237, as best seen in FIG. 13. The connector pin 241 is attached to the socket 247. The arrangement allows the pin block 237 to be removably plugged into the printed wiring board 245 and likewise allows the pogo pin assemblies 228 to be removably plugged into the sockets 247 in the pin block 237.

A significant advantage of the push-lock BNC connector 10 according to the present invention is that it can be engaged with a female BNC connector without the need to manually rotate a locking collar to engage the locking pins on the female BNC connector. Instead, the two connectors can be engaged by simply pushing together the two connector portions 10 and 12. The connectors can be disengaged by simply moving the tab 60 in the direction of arrow 80 which rotates the locking sleeve 22 to the unlocked position 61'. The connector 10 can then be pulled away from the female connector portion 12. Consequently, the push-lock BNC connector does not require a significant amount of manual dexterity on the part of the user. Another advantage is that the connector 10 can be more easily used in installations where there would otherwise be insufficient clearance to allow the user to manually rotate the locking collar of a conventional BNC connector.

Other advantages are associated with the alignment sleeve 26. For example, the alignment sleeve 26 provides a positive rotational index between the connector 10 and the female connector portion 12 before the connectors are engaged, thereby allowing any supplemental electrical connectors, such as contact pins 28, to be aligned without the need for a separate indexing system. Similarly, when the connector 10 is fully engaged and in the locked position, the alignment sleeve 26 prevents the connector 10 from rotating, thereby allowing a simple pin/contact pad arrangement to be used to transmit supplemental electrical signals through the connector.

Still other advantages are associated with the supplemental electrical connector assembly 235 that may be used to transmit supplemental electrical signals across the connector junction. For example, since the pogo pins 228 are aligned with the printed wiring board 245, they can be directly connected thereto, thus dispensing with the need for flexible wires or flexible printed wiring boards to connect the pins to the circuit board 245. Indeed, the modular, "plug-in" arrangement of the various components of the supplemental electrical connector assembly 235 eliminates the need for hand soldering operations, as the female connector block 253 may be soldered directly to the printed wiring board 245 by conventional, automated "surface mount technology" (SMT) procedures. The pin block 237 may then simply be plugged into the printed wiring board 245, and the entire assembly may then be placed into the bottom half 243 of the connector housing. In one embodiment, the pogo pin assemblies 228 may then be plugged into the electrically conductive sockets 247 captured within the pin block 237. The arrangement also allows the printed wiring board 245 to be located away from the male connector portion 216, thereby allowing the signal cable 231 to be connected directly to the connector 216. The arrangement also allows increased room for electronic components and/or connectors on the printed wiring board 245 without increasing the size of the housing 220.

Having briefly described the push-lock BNC connector 10 (e.g., FIG. 2) and the supplemental connector assembly 235 (e.g., FIG. 10), as well as some of their more significant features and advantages, the push-lock BNC connector 10 and supplemental connector assembly 235 will now be described in detail.

Referring back now to FIGS. 2, 3, and 4, the push-lock BNC connector 10 is shown as it could be used with an "active" probe assembly of the type commonly used with electronic test equipment (not shown), such as oscilloscopes or other test and measurement equipment. In such an application, the push-lock BNC connector 10 may be incorporated into the main connector body 42 of the active probe assembly in the manner best seen in FIG. 4. The electronic circuitry (not shown) associated with the active probe assembly may be connected to the electronic test equipment (not shown) associated with the female connector portion 12 by a plurality of electrically conductive pins 28 which make electrical contact with a plurality of corresponding contact pads 14 associated with the female connector portion 12

(FIG. 3). The pins 28 and contact pads 14 allow for the transmission of the supplemental electrical signals required to operate the active probe assembly. However, it should be understood that the use of such additional electrical connectors, such as pins 28 and contact pads 14, are not required to achieve the objects of this invention and the push-lock BNC connector could be used just as easily with conventional plain female BNC connectors, such as the female connector 11 shown in FIG. 1.

Figure 5:
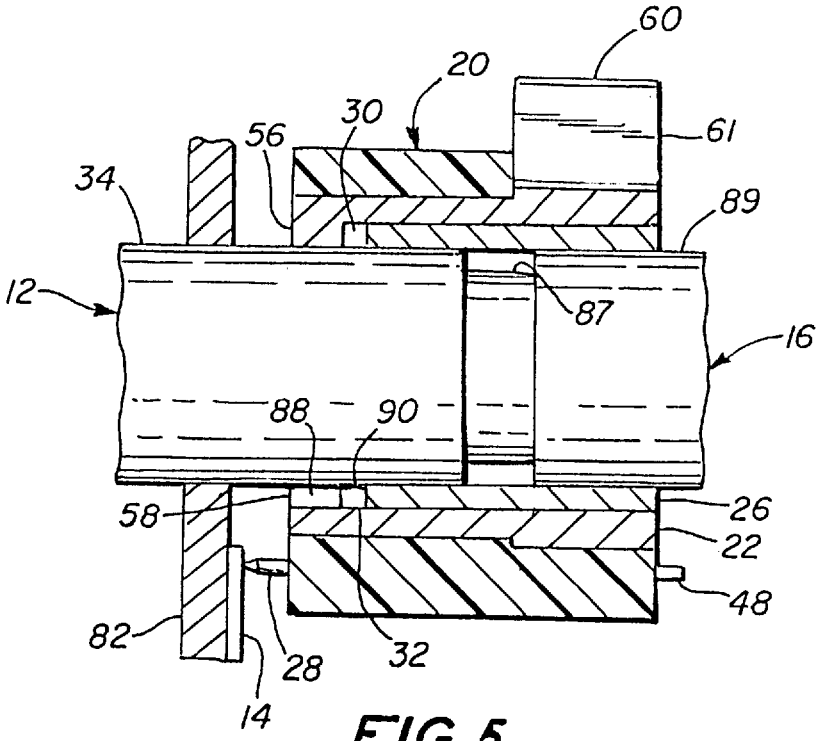
FIG. 5 is a sectional view in elevation showing the engagement of the male push-lock BNC connector with a female BNC connector assembly.

The female connector portion 12 is best seen in FIG. 3 as it could comprise part of a front panel assembly 82 of an oscilloscope or other test and measurement equipment (not shown). The female connector portion 12 is of the conventional configuration and includes a female receptacle 84 adapted to receive the center conductor 86 (FIGS. 4, 7) of the male BNC center terminal 16. A sleeve 34 surrounds the female receptacle 84 and makes electrical contact with the outer conductor 87 of the male BNC center terminal 16. The sleeve 34 also includes a pair of locking pins 30 and 32 positioned in substantially diametrically opposed relation as best seen in FIGS. 3 and 5. Depending on the application, the female connector portion 12 may also include a plurality of contact pads 14 for making electrical contact with the pins 28 contained on the push-lock connector assembly 10. Such an arrangement will allow for the transmission of supplemental electrical signals through the connector 10, such as may be required for the operation of active probe assemblies. In one preferred embodiment, the contact pads 14 may comprise part of a flexible printed wiring board (not shown) of the type well-known in the art. However, other devices exist and could be substituted for the contact pad/pin arrangement shown and described herein without departing from the spirit and scope of the present invention.

The details of the push-lock BNC connector assembly 10 are best seen in FIG. 4 with occasional reference to FIGS. 2 and 5–7. Essentially, the push-lock BNC connector assembly 10 comprises a conventional male BNC center terminal 16 and a locking assembly 18 which may be mounted to the main connector body 42 of an active probe assembly. The male BNC center terminal 16 may be mounted to the main connector body 42 of the active probe assembly by any convenient means, such as by screw threads 98 and may be electrically connected to the electronic circuitry (not shown) contained within the main connector body 42 in the conventional manner. Electrical power and/or other electronic data signals may be provided to/from the electronic circuitry (not shown) contained in the main connector body 42 by the plurality of contact pins 28 (FIG. 2). In one preferred embodiment, the contact pins 28 are removable and are slidably received by corresponding contact pin sockets 48 which extend from the main connector body 42. The contact pin sockets 48 are in turn connected to the electronic circuitry (not shown) mounted within the main connector body 42. The particular type of contact pins 28 and contact pin sockets 48 that may be used with the present invention are not critical and any of a number of commercially available contact pin/socket assemblies may be used without departing from the present invention. By way of example, one preferred embodiment utilizes a plurality of spring-loaded or "pogo" contact pins 28 and corresponding socket assemblies 48 available as respective model nos. S2J4G and R2RP from Interconnect Devices, Inc., of Kansas City, Kans., although other types of pins and/or pin socket assemblies could also be used.

The locking assembly 18 comprises a housing 20, a locking sleeve 22, a spring 24, and an alignment sleeve 26. The arrangement is such that the housing 20 receives locking sleeve 22, which in turn receives the alignment sleeve 26. The entire locking assembly 18 fits over the outer sleeve 89 of the male BNC center terminal 16, as best seen in FIG. 5. In one preferred embodiment, the housing 20 is generally rectangular in shape, although other configurations are possible, and includes a central bore 36 therethrough sized to receive the cylindrical body portion 50 of locking sleeve 22. The central bore 36 also includes a pair of alignment tabs 38 and 40 positioned in generally diametrically opposed relation, as best seen in FIG. 4. Housing 20 may be secured to the main connector body 42 of the active probe assembly (not shown) by any convenient fastener system, such as by a pair of screws (not shown) through holes 44, 46. If it is desired to provide the connector assembly 10 with supplemental electrical conductors, such as a plurality of contact pins 28 (FIG. 2), the housing 20 should also include a plurality of holes 49 (FIG. 4) sized and spaced to receive the contact pin sockets 48 that extend from the main connector body 42.

The housing assembly 20 may be made from any of a wide variety of materials, such as metals or plastics, suitable for the intended application. In one preferred embodiment, the housing assembly 20 is molded as a single piece from ABS plastic, although other materials could also be used, as would be obvious to persons having ordinary skill in the art.

The locking sleeve 22 comprises an elongate, cylindrically shaped body portion 50 having a central bore 62 therethrough adapted to slidably receive the alignment sleeve 26. See FIGS. 4 and 5. The body portion 50 includes a pair of slots 52, 54 for engaging the alignment tabs 38 and 40 on the housing 20. The slots 52 and 54 are wider than the alignment tabs 38 and 40 so that the locking sleeve 22 can be rotated between the locked position 61 and the unlocked position 61'. See FIGS. 6 and 7.

Locking sleeve 22 also includes a pair of locking pin engaging bosses 56 and 58 that engage the locking pins 30 and 32 on the sleeve 34 of female connector portion 12. See FIGS. 3 and 5. The bosses 56 and 58 are essentially identical and are located at substantially diametrically opposed positions within the central bore 62 so that they will engage the respective locking pins 30 and 32 on the sleeve 34 of the female connector assembly 12.

Referring now specifically to FIG. 4 and to boss 58, boss 58 includes an inclined ramp section 88 which terminates at an essentially transverse pin stop section 90. Boss 56 is in every way identical to boss 58 and includes a ramp section 85 (FIG. 7) which terminates at a transverse pin stop (not shown). Bosses 56 and 58 are mirror images of one another so that the pins 30, 32 on the female connector assembly 12 engage the respective ramp sections (e.g., 88, 85) as the locking sleeve 22 slides over the sleeve 34 of the female connector portion 12. As will be described in greater detail below, the engagement of the locking pins 30, 32 with the ramp sections (e.g., 88, 85) of the respective bosses 56, 58 causes the locking sleeve 22 to rotate in the direction of arrow 80 to the unlocked position 61' (FIG. 6) as the connector assembly 10 is moved over the sleeve 34 of female connector portion 12. When the connectors are fully engaged, the locking pins 30, 32 of the sleeve 34 of female connector 12 are engaged with the transverse pin stops (e.g., 90) of the respective locking pin engaging bosses 56, 58. See FIG. 5. The locking sleeve 22 also includes an integral tab 60 to allow the user (not shown) to release a locked connector assembly by moving the tab 60 in the direction of arrow 80 which rotates the locking sleeve 22 to the unlocked position 61'. See FIG. 6.

The locking sleeve 22 may be made from any of a wide variety of materials, such as metals or plastics, that would be suitable for the intended application. In one preferred embodiment, the locking sleeve is made from a single piece of stainless steel, although other materials could also be used, as would be obvious to persons having ordinary skill in the art.

The locking sleeve 22 is biased in the locked position 61 (FIG. 6) by a spring 24 which engages a small hole 92 in the locking sleeve 22. See FIG. 4. The spring 24 fits within a recess 94 in housing 20, as is best seen in FIG. 6. The spring 24 thus biases the locking sleeve in the locked position 61. It should be noted that a wide range of springs and other biasing devices well-known in the art could be used to bias the locking sleeve 22 in the locked position 61, as would be obvious to persons having ordinary skill in the art. Therefore, the present invention should not be regarded as limited to any one particular spring arrangement for biasing the locking sleeve 22 to the locked position 61.

Referring back now to FIG. 4, the alignment sleeve 26 is generally cylindrically shaped and includes a central bore 96 therethrough that is sized to receive the male BNC center terminal 16. The alignment sleeve 26 provides a defined rotational alignment for the connector portion 10 with respect to the female connector portion 12 and also prevents the connector assembly 10 from rotating on the female connector portion 12 once it is fully engaged and locked. Consequently, the push-lock BNC connector assembly 10 can accommodate the pin 28 and pad 14 arrangement (FIGS. 2 and 3) without the need for a separate indexing device to ensure that the various pins 28 contact the proper contact pads 14.

Still referring to FIG. 4, the alignment sleeve 26 includes a pair of notches 64 and 66 that engage the respective alignment tabs 38 and 40 of the housing 20. The engagement of the notches 64, 66 with the tabs 38, 40 prevents the alignment sleeve 26 from rotating with respect to the housing 20. Alignment sleeve 26 also includes a pair of indexing slots 68 and 70 for engaging the locking pins 30, 32 on the sleeve 34 of the female connector portion 12. A pair of clearance slots 72, 74 provide clearance for the locking pin engaging bosses 56, 58 on the locking sleeve 22 and allow the locking sleeve 22 to rotate between the locked position 61 and the unlocked position 61' (FIG. 6).

As was the case for the locking sleeve 22, the alignment sleeve 26 may be made from any of a wide range of materials that would be suitable for the expected application and environment. In one preferred embodiment, the alignment sleeve 26 is made from a single piece of stainless steel, although other materials, such as plastic, could also be used.

The entire locking assembly 18, comprising the housing 20, locking sleeve 22, spring 24, and alignment sleeve 26, fits over the sleeve 89 of male BNC center terminal 16, as best seen in FIG. 5, and provides the male BNC center terminal 16 with a push-lock engagement with the female BNC connector assembly 12 (FIG. 3). In order to engage the connector assembly 10 with the female BNC connector assembly 12, the user (not shown) would first align the engagement slots 76, 78 (i.e., the slots defined between the engaging bosses 56, 58 and the indexing slots 68, 70) with the locking pins 30, 32 of the female connector 12. See FIGS. 2 and 7. This alignment defines the rotational alignment between the connector assembly 10 and the female connector portion 12. Having so aligned the connectors, the operator would then push the connector assembly 10 over the sleeve 34 of the female connector 12. As this is done, the locking pins 30, 32 engage the ramp sections (e.g., 88, 85) of the respective locking pin engaging bosses 56, 58, which causes the locking sleeve 22 to rotate in the direction of arrow 80 against the pressure exerted by spring 24 (i.e., toward the unlocked position 61'). When the connector 10 is fully inserted on the female connector portion 12, the locking pins 30, 32 clear the ramp sections (e.g., 88, 85) of the bosses 56, 58, at which time the pressure exerted by spring 24 returns the locking sleeve 22 to the locked position 61 (FIGS. 5 and 6). The locking pins 30, 32 are now engaged with the transverse pin stops (e.g., 90) of the bosses 56, 58, and securely hold the connector 10 in engagement with the female connector portion 12. The pins 30, 32 are also fully engaged with the indexing slots 68, 70 in the alignment sleeve 26, and prevent the connector 10 from rotating about the female connector portion 12.

Figure 9:
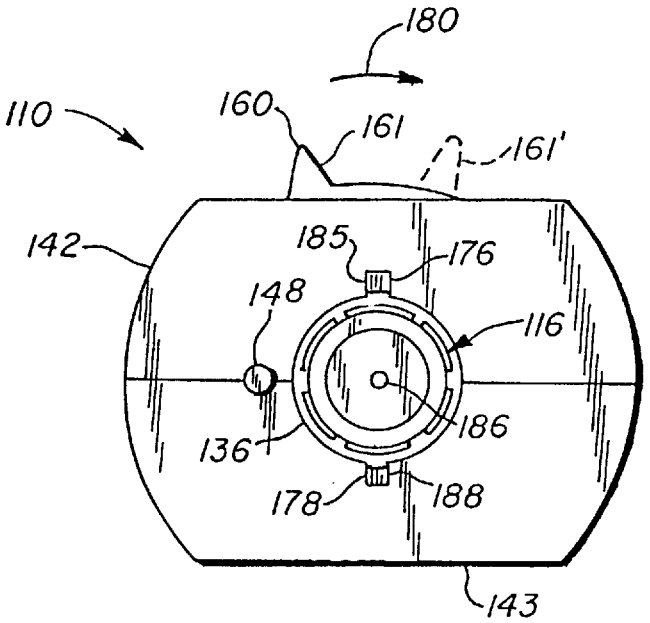
FIG. 9 is a front view in elevation of the push-lock BNC connector shown in FIG. 8.
Figure 8:
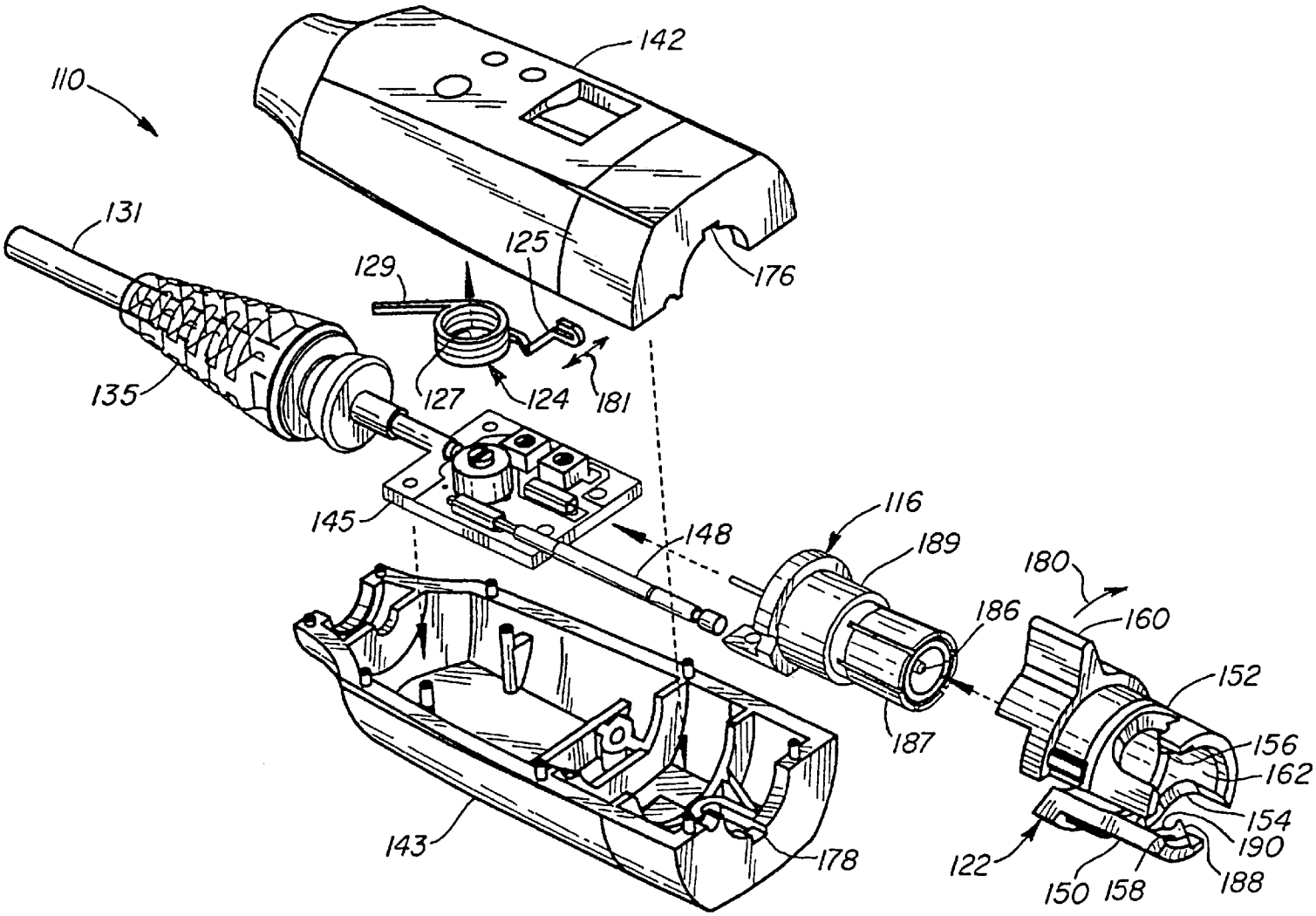
FIG. 8 is an exploded perspective view of another embodiment of the male push-lock BNC connector according to the present invention.

A second embodiment 110 of the push-lock BNC connector assembly according to the present invention is shown in FIGS. 8 and 9. The main difference between the second embodiment 110 and the first embodiment 10 is that the second embodiment 110 does not include a separate alignment sleeve, such as alignment sleeve 26 used in the first embodiment 10. Instead, the alignment function in the second embodiment 110 is provided by the two main connector body halves 142, 143. That is, when assembled, each main connector body half 142, 143 defines a circular opening 136 (FIG. 9) which includes a pair of alignment notches 176, 178 for engaging the locking pins 30, 32 on the female BNC connector assembly 12 (FIG. 3). The push-lock engagement feature is the same for the second embodiment 110, and the connector 110 can be engaged with the female connector assembly 12 by simply sliding it over the female connector assembly 12 until it is fully engaged, at which point the locking sleeve 122 will spring back to the locked position 161. The connector 110 can then be disengaged or removed from the female connector 12 by simply moving the releasing tab 160 to the unlocked position 161' and then sliding the connector 110 away from the female connector portion 12.

The details of the second embodiment 110 of the push-lock BNC connector are best seen in FIG. 8, with occasional reference to FIG. 9. Essentially, the connector 110 includes two main connector body halves 142, 143 for housing a PC board assembly 145, a male BNC center terminal 116, the locking sleeve 122, and a return spring 124. In one preferred embodiment, the two main connector body halves 142, 143 are also adapted to engage a strain relief section 135 associated with cable 131. The connector assembly 110 may also include an elongate contact pin socket 148 for receiving a contact pin (not shown in FIG. 8), such as contact pin 28 used in the first embodiment 10. See FIG. 2. As was the case for the first embodiment 10, the elongate contact pin socket 148, along with a suitable contact pin (not shown), such as contact pin 28, may be used to electrically connect the PC board assembly 145 to the instrument (not shown) associated with the female BNC connector assembly 12 for the purposes of providing a supplemental electrical current or signal. By way of example, such a supplemental electrical signal could comprise a probe identification signal to allow the instrument (not shown) associated with the female connector 12 to calibrate itself with respect to the particular probe being used. Since such probe identification functions are well-known in the art, the probe pin and PC board assembly 145 associated with the second embodiment 110 will not be described in further detail.

In one preferred embodiment, the two halves 142, 143 of the main connector body may be molded from ABS/PC plastic, although other materials could also be used, as would be obvious to persons having ordinary skill in the art.

The male BNC center terminal 116 is essentially identical to the male connector assembly 16, and includes a center conductor 186 surrounded by an outer conductor sleeve 187 which itself is surrounded by outer sleeve 189. The male BNC center terminal 116 may be connected to the PC board assembly 145 by any number of well-known means, such as by connectors or by solder, and may be secured within the two halves 142, 143 of the main connector body by appropriate support members integral with the two halves 142, 143.

The locking sleeve 122 differs somewhat from the locking sleeve 22 associated with the first embodiment 10. Still referring to FIG. 8, the locking sleeve 122 comprises an elongate cylindrical body section 150 having a central bore 162 therethrough adapted to receive the BNC center terminal 116. The body portion 150 includes a pair of slots 152, 154 for engaging the pins 30, 32 on the sleeve 34 of the female connector portion 12 (FIG. 3). The slots 152 and 154 also allow the locking sleeve 122 to be rotated between the locked position 161 and the unlocked position 161'. See FIG. 9.

Locking sleeve 122 also includes a pair of locking pin engaging bosses 156 and 158 that engage the locking pins 30 and 32 on the sleeve 34 of female connector portion 12. The bosses 156 and 158 are essentially identical and are located at substantially diametrically opposed positions within the central bore 162 so that they will engage the respective locking pins 30 and 32 on the sleeve 34 of the female connector assembly 12.

Referring now specifically now to FIG. 8 and to boss 158, boss 158 includes an inclined ramp section 188 which terminates at an essentially transverse pin stop 190. Boss 156 is in every way identical to boss 158 and includes a ramp section 185 (FIG. 9) which terminates at a transverse pin stop (not shown). As was the case in the first embodiment 10, bosses 156 and 158 are also mirror images of one another so that the pins 30, 32 on the female connector assembly 12 engage the respective ramp sections (e.g., 188, 185) as the locking sleeve 122 slides over the sleeve 34 of the female connector portion 12. The engagement of the locking pins 30, 32 with the ramp sections (e.g., 188, 185) of the respective bosses 156, 158 causes the locking sleeve 122 to rotate in the direction of arrow 180 to the unlocked position 161' (FIG. 9) as the connector assembly 110 is moved over the sleeve 34 of female connector portion 12. When the connectors are fully engaged, the locking pins 30, 32 of the sleeve 34 of female connector 12 are engaged with the transverse pin stops (e.g., 190) of the respective locking pin engaging bosses 156, 158. The locking sleeve 122 also includes an integral tab 160 to allow the user (not shown) to release a locked connector assembly by moving the tab 160 in the direction of arrow 180 which rotates the locking sleeve 122 to the unlocked position 161'. See FIG. 9.

The locking sleeve 122 may be made from any of a wide variety of materials, such as metals or plastics, that would be suitable for the intended application. In one preferred embodiment, the locking sleeve is made from a single piece of glass-reinforced polyetherimide plastic, although other materials could also be used, as would be obvious to persons having ordinary skill in the art.

The locking sleeve 122 is biased in the locked position 161 (FIG. 9) by a spring 124 having a small tang end 125 which engages a hole (not shown) in the locking sleeve 122. See FIG. 8. The spring 124 may be retained within the top half 142 of the main connector body by any suitable device, such as a small cylindrically shaped post (not shown) sized to fit within the opening 127 of spring 124. The plain end 129 of spring 124 should be secured to the top half 142 of the main connector body. Essentially, then, the tang end 125 of spring 124 will move back and forth in the direction of arrows 181 as the locking sleeve 122 is moved back and forth between the locked and unlocked positions 161 and 161'.

It should be noted that a wide range of springs and other biasing devices well-known in the art could be used to bias the locking sleeve 122 in the locked position 161, as would be obvious to persons having ordinary skill in the art. Therefore, the present invention should not be regarded as limited to any one particular spring arrangement for biasing the locking sleeve 122.

As was mentioned above, any of the embodiments of the push-lock BNC connector (e.g., 10, 110) may be provided with a plurality of contact pins (e.g., pins 28, FIG. 2) for making electrical contact with a plurality of corresponding contact pads 14 positioned adjacent the female BNC connector 12 (FIG. 3). The pins 28 and contact pads 14 allow for the transmission of supplemental electrical signals across the connector union, such as may be required for "active" probe assemblies, i.e., probe assemblies having on-board electronic circuitry.

Figure 10:
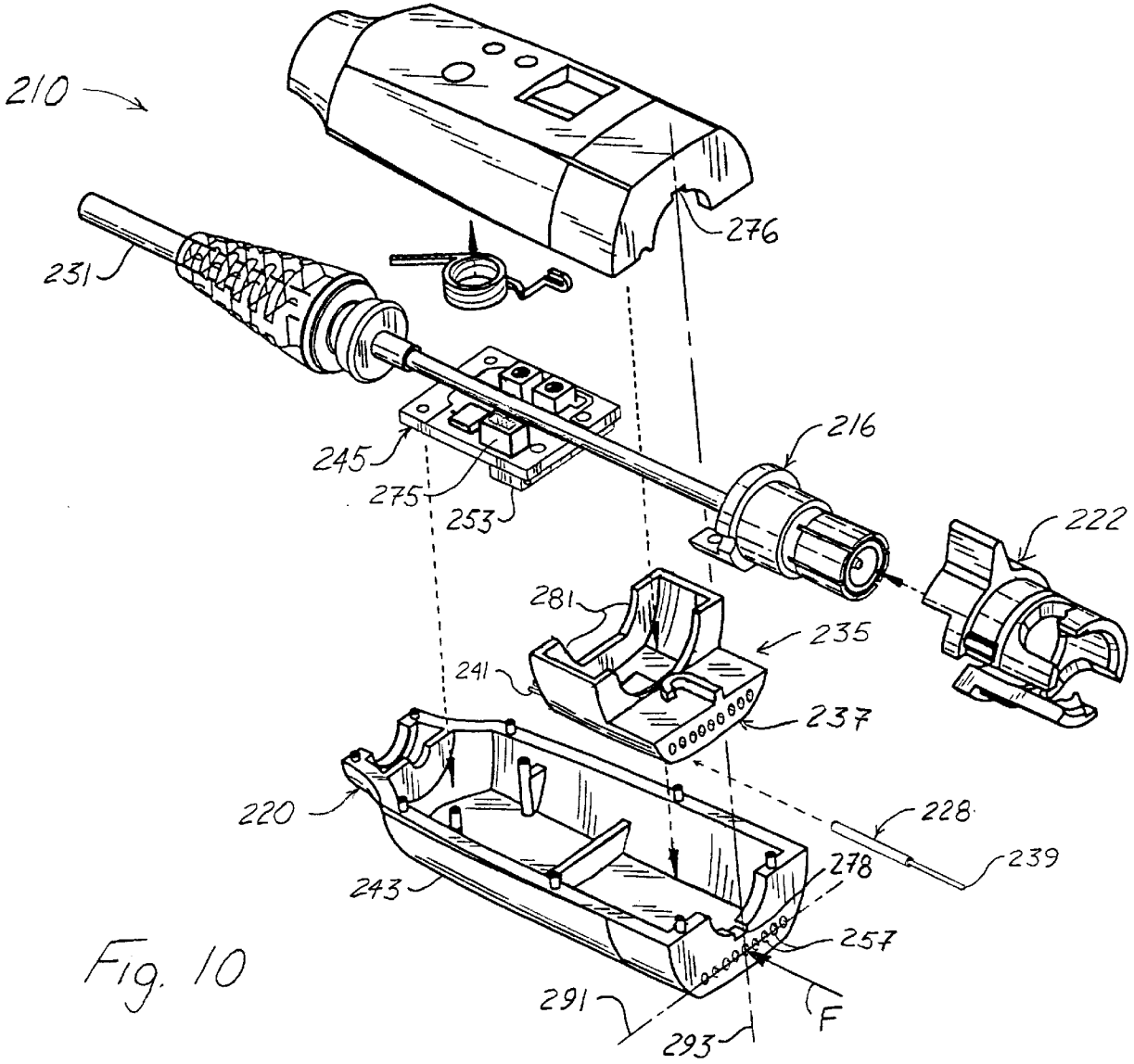
FIG. 10 is an exploded perspective view of a supplemental electrical connector assembly as it could be used in conjunction with the male push-lock BNC connector associated with an "active" probe.
Figure 11:
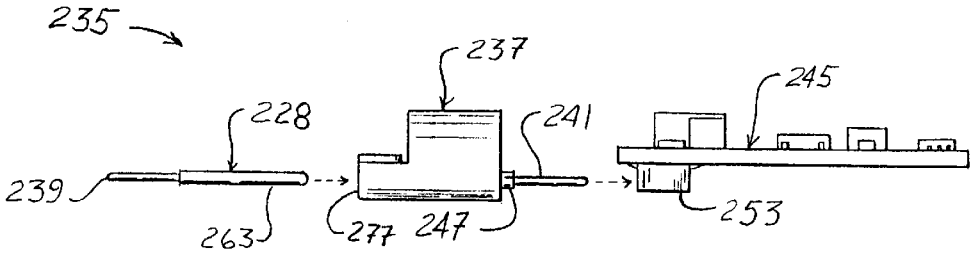
FIG. 11 is an exploded side view in elevation of the supplemental electrical connector assembly shown in FIG. 10.
Figure 12:
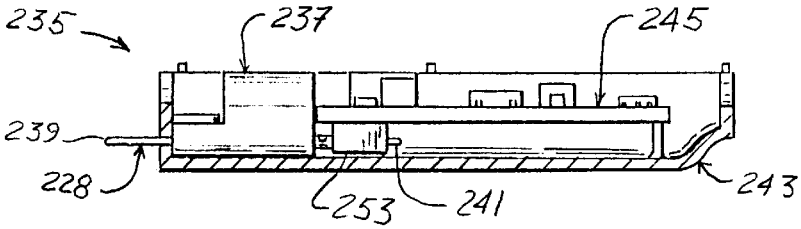
FIG. 12 is a side view in elevation of the supplemental electrical connector assembly showing its connection with a printed wiring board contained within the lower half of the push-lock connector housing.

Referring now to FIGS. 10–14, a supplemental electrical connector assembly 235 is shown as it could be incorporated into a push-lock BNC connector 210 of the type described above and shown in FIGS. 8 and 9. Alternatively, however, the supplemental electrical connector assembly 235 could also be incorporated into the push-lock BNC connector 10 of the type shown in FIGS. 2 and 4–7. In any event, the supplemental electrical connector assembly 235 may comprise a pin block 237 for holding a plurality of pogo pin assemblies 228. The various pogo pin assemblies 228 are in turn connected to the various circuit nodes (not shown) on the printed wiring board 245 via a plurality of corresponding connector pins 241 which engage a female connector block 253, as best seen in FIGS. 11 and 12.

The printed wiring board 245 may be connected to the active probe tip (not shown) located at the end of the cable 231 by a suitable wiring harness (not shown). The wiring harness (not shown) may be connected to the printed wiring board 245 by a connector (not shown) adapted to engage a mating connector 275 on wiring board 245. See FIG. 10. The wiring harness (not shown) may be mounted alongside cable 231 or may be contained within the outer insulation sheath of cable 231.

It is preferred, but not required, that the various pogo pin assemblies 228 be arranged along a line 291 that is generally perpendicular to an axis 293 that includes the notches 276, 278 that receive the engaging pins 30, 32 on the female connector assembly 12 (FIG. 3). As mentioned above, such an arrangement minimizes the tendency for the spring biased pogo pins 228 to tilt or cock the connector 210 on the female connector 12 when the two connectors are engaged. That is, the engagement pins 30, 32 on female connector 12 can oppose the force F exerted by the pogo pins 228 on the body 220 when the pogo pins 228 are arranged along line 291. In contrast, if the various pins 228 were arranged along a line (not shown) generally parallel to the axis 293, then the force exerted on the connector body 220 by the various pins 228 would tend to cock or tilt the connector 210 on the female connector assembly 12. It is also preferred, but not required, that approximately the same number of pogo pins 228 be located on either side of axis 293, again to minimize the tendency for the pins 228 to tilt or cock the connector 210.

The details of the pin block 237 are best seen in FIGS. 10 and 13. Essentially, pin block 237 is sized to fit within the lower half 243 of housing 220 and may also include various structural features 281 adapted to receive and support the locking sleeve 222. Alternatively, the housing 220 could be adapted to receive the locking sleeve 222. In any event, the pin block 237 is configured to receive at least one pogo pin assembly 228 that may be used to electrically connect various desired circuit nodes (not shown) on printed wiring board 245 with the appropriate supplemental contact pads, such as contact pads 14 adjacent the mating connector portion 12. See FIG. 3.

Each pogo pin assembly 228 is slidably received by a mating socket portion 247 that is retained by the pin block 237, thereby allowing for the easy and convenient removal and/or replacement of the various pogo pin assemblies 228. Referring now to FIG. 13, each socket portion 247 may comprise an elongate cylindrical socket having an interior bore 259 therein. The connector pin 241 is attached to the socket portion 247 and extends from the rear end 273 of pin block 237 so that each connector pin 241 may be engaged with the appropriate mating socket (not shown) on female connector 253 mounted to printed wiring board 245. The connector pin 241 may be integral with the socket portion 247, i.e, the connector pin 241 and socket portion 247 may comprise a single piece. Alternatively, the connector pin 241 may comprise a separate element that may be attached to the socket portion 247 by any convenient means, such as by crimping or welding.

Figure 14:
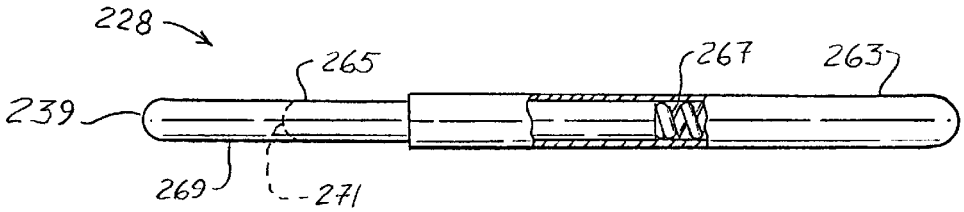
FIG. 14 is a side view in elevation of a pogo pin assembly with a portion of the male connector sleeve broken away to show the spring for biasing the contact pin toward the extended position.

Turning now to FIGS. 13 and 14, the interior bore 259 of each socket member 247 is sized to slidably receive the male connector sleeve 263 of the pogo pin assembly 228 so that the pogo pin assembly 228 extends out from the front end 277 of pin block 237. See also FIGS. 11 and 12. Each pogo pin assembly 228 comprises a male connector sleeve 263 adapted to slidably receive a contact pin 265 so that it can move between an extended position 269 and a retracted position 271. A suitable biasing device, such as a spring 267 positioned within the male connector sleeve 263, biases the contact pin 265 in the extended position 269. In order to ensure good electrical contact and maximum signal performance, it is preferred, but not required, that the connector pin 265, male connector sleeve 263, socket 247, and connector pin 241 be plated with a highly conductive, non-corrosive material, such as gold.

As mentioned above, the various sockets 247 are retained within the pin block 237. Accordingly, in one preferred embodiment, pin block 237 comprises a plastic material, such as, for example, an acrylonitrile butadiene styrene (ABS) polycarbonate plastic material, and is "overmolded" over the various socket portions 247 so that the same are fixedly retained within the pin block 237. However, other fabrication techniques are known and may be used in the alternative to fabricate the pin block 237 and to incorporate the various sockets 247 therein. For example, the sockets 247 could be a press fit within holes provided in the pin block 237.

Any of a wide variety of pogo pins 228 and sockets 247 may be used to provide the electrical connection between the female socket 253 and the contact pads 14 (FIG. 3). In one preferred embodiment, the pogo tip assembly 228 comprises a model no. S2J4G probe tip available from Interconnect Devices, Inc., of Kansas City, Kans. Similarly, the socket portion 247 comprises a model no. R2RP probe tip socket which is also available from Interconnect Devices, Inc.

The supplemental connector assembly 235 provides a convenient means for connecting the printed wiring board 245 to the various pogo pins 228 without the need for flexible cables and/or printed wiring boards and without the need to resort to hand soldering. The female connector portion 253 for receiving the various connector pins 241 may be soldered to the printed wiring board 245 by conventional automated methods. The supplemental connector assembly 235 may then be formed by connecting the pin block 237 to the printed wiring board 245 by engaging the various connector pins 241 with the female connector 253 and sliding them home. The printed wiring board 245 and pin block 237 may then be positioned in the bottom half 243 of housing assembly 220. The pogo pins 228 may then be inserted into the various sleeves 247 in the pin block by sliding them through the holes 257 in the lower half 243 of housing assembly 220. See FIG. 12.

This completes the detailed description of the preferred embodiments of the push-lock BNC connector according to the present invention. While a number of specific components were described above for the preferred embodiments of this invention, persons having ordinary skill in this art will readily recognize that other substitute components or combinations of components may be available now or in the future to accomplish comparable functions to the apparatus described herein. For example, while the present invention was shown and described herein as it could be used with "active" probe assemblies, it could be used just as easily with "passive" probe assemblies, in which case there may be no need for the optional contact pins 28 for conducting supplemental electrical currents or signals through the connector union.

Therefore, it is contemplated that the inventive concepts herein described may be variously otherwise embodied and it is intended that the appended claims be construed to include alternative embodiments of the invention except insofar as limited by the prior art.

What is claimed is:

1. A supplemental electrical connector assembly for transmitting at least one supplemental electrical signal to a supplemental contact pad associated with a mating electrical connector pair, the mating electrical connector pair including a first connector portion and a second connector portion, the supplemental contact pad being positioned adjacent the second connector portion, comprising:

a pin block having a front end and a rear end, said pin block being mounted to the first connector portion of the mating connector pair;

a pogo pin assembly having a proximal end and a distal end, said pogo pin assembly having a connector pin positioned at the proximal end and a contact pin positioned at the distal end, said pogo pin assembly being mounted to said pin block so that the contact pin extends from the front end of said pin block and so that the connector pin extends from the rear end of said pin block, whereby the contact pin makes electrical contact with the supplemental contact pad when the first connector portion of the mating electrical connector air is engaged with the second connector portion of the mating electrical connector pair; and a printed wiring board attached to the first connector portion of the mating electrical connector pair, said printed wiring board having a female connector assembly mounted thereto, the female connector assembly being sized to removably engage the connector pin on said pogo pin assembly.

2. The supplemental electrical connector assembly of claim 1, wherein said pin block contains an aperture therein extending from the front end of said pin block to the rear end of said pin block and wherein the aperture is sized to receive said pogo pin assembly.

3. The supplemental electrical connector assembly of claim 1, wherein said pogo pin assembly comprises:

an electrically conductive socket having the connector pin attached to one end thereof;

a removable pogo tip assembly sized to be received by said electrically conductive socket.

4. The supplemental electrical connector assembly of claim 3, wherein said removable pogo tip assembly includes:

a male connector sleeve, said male connector sleeve being sized to be received by said electrically conductive socket; and a moveable contact pin having a tip portion, said moveable contact pin being sized to be slidably received by the male connector sleeve so that the tip portion is moveable back and forth from an extended position to a retracted position.

5. The supplemental electrical connector assembly of claim 4, wherein said moveable contact pin is biased toward the extended position.

6. The supplemental electrical connector assembly of claim 1, wherein said pin block comprises a plastic material and is overmolded on said pogo pin assembly.

7. The supplemental electrical connector assembly of claim 6, wherein said plastic material comprises acrylonitrile butadiene styrene (ABS) plastic.

8. The supplemental electrical connector assembly of claim 1, wherein the first connector portion is mounted within a housing and wherein said pin block is mounted within said housing.

9. The supplemental electrical connector assembly of claim 1, wherein the first electrical connector portion comprises a male BNC connector and wherein the second electrical connector portion comprises a female BNC connector.

10. An electrical connector assembly, comprising:

a first connector portion;

a housing adapted to receive the first connector portion;

a pin block having a front end and a rear end, said pin block being mounted within said housing;

a pogo pin assembly having a proximal end and a distal end, said pogo pin assembly having a connector pin positioned at the proximal end and a contact pin positioned at the distal end, said pogo pin assembly being mounted to said pin block so that the contact pin extends from the front end of said pin block and so that the connector pin extends from the rear end of said pin block;

a second connector portion adapted to receive said first connector portion, said first and second connector portions comprising a mating electrical connector pair;

a supplemental contact pad positioned adjacent said second connector portion of the mating electrical connector pair so that the contact pin makes electrical contact with the supplemental contact pad when the first connector portion of the mating electrical connector pair is engaged with the second connector portion of the mating electrical connector pair; and a printed wiring board attached to the first connector portion of the mating electrical connector pair, said printed wiring board having a female connector assembly mounted thereto, the female connector assembly being sized to removably engage the connector pin on said pogo pin assembly.

11. The electrical connector assembly of claim 10, wherein said pin block contains an aperture therein extending from the front end of said pin block to the rear end of said pin block and wherein the aperture is sized to receive said pogo pin assembly.

12. The electrical connector assembly of claim 10, wherein said pogo pin assembly comprises:

an electrically conductive socket having the connector pin attached to one end thereof;

a removable pogo tip assembly sized to be received by said electrically conductive socket.

13. The electrical connector assembly of claim 12, wherein said removable pogo tip assembly includes:

a male connector sleeve, said male connector sleeve being sized to be received by said electrically conductive socket; and a moveable contact pin having a tip portion, said moveable contact pin being sized to be slidably received by the male connector sleeve so that the tip portion is moveable back and forth from an extended position to a retracted position.

14. The electrical connector assembly of claim 13, wherein said moveable contact pin is biased toward the extended position.

15. The electrical connector assembly of claim 10, wherein said pin block comprises a plastic material and is overmolded on said pogo pin assembly.

16. The electrical connector assembly of claim 15, wherein said plastic material comprises acrylonitrile butadiene styrene (ABS) plastic.

17. A push-lock connector assembly for releasably engaging a female BNC connector and for making electrical contact with a supplemental contact pad positioned adjacent the female BNC connector, comprising:

a male BNC center terminal;

a locking assembly associated with said male BNC center terminal, said locking assembly including, a housing having a central aperture therein and adapted to be mounted to said male BNC center terminal so that said male BNC center terminal is substantially aligned with the central aperture in said housing, said housing also having at least one supplemental aperture therein positioned adjacent the central aperture;

a locking sleeve having a central aperture therein sized to receive said male BNC center terminal, said locking sleeve being adapted to be slidably received by the central aperture of said housing so that said locking sleeve can be rotated within said housing from a locked position to an unlocked position, said locking sleeve also including a locking pin engaging boss for releasably engaging a locking pin associated with the female BNC connector, wherein said locking pin engaging boss rotates said locking sleeve to the unlocked position as said push-lock connector assembly is engaged with the female BNC connector and allows the locking sleeve to be rotated to the locked position when said male BNC center terminal and the female BNC connector are fully engaged; and a biasing device associated with said locking sleeve for biasing said locking sleeve in the locked position;

a pin block having a front end and a rear end, said pin block being mounted within said housing; and a pogo pin assembly having a proximal end and a distal end, said pogo pin assembly having a connector pin positioned at the proximal end and a contact pin positioned at the distal end, said pogo pin assembly being mounted to said pin block so that the contact pin extends from the front end of said pin block and through the supplemental aperture in said housing and so that the connector pin extends from the rear end of said pin block, so that the contact pin makes electrical contact with the supplemental contact pad when said push-lock connector assembly is engaged with the female BNC connector.

18. A method for connecting a BNC electrical connector assembly, the BNC electrical connector assembly including a male BNC connector portion and a female BNC connector portion and also including a supplemental contact pad positioned adjacent the female BNC connector portion, comprising the steps of:

aligning the male BNC connector portion with the female BNC connector portion, the male BNC connector portion including a pin block having a front end and a rear end mounted to the male BNC connector portion, and a pogo pin assembly having a proximal end and a distal end, said pogo pin assembly having a connector pin positioned at the proximal end and a contact pin positioned at the distal end, said pogo pin assembly being mounted to said pin block so that the contact pin extends from the front end of said pin block and so that the connector pin extends from the rear end of said pin block; and moving the male BNC connector portion into engagement with the female BNC connector portion until the male and female BNC connector portions are fully engaged and the contact pin makes electrical contact with the supplemental contact pad.

19. A supplemental electrical connector assembly for use with a BNC electrical connector assembly, the BNC electrical connector assembly including a male BNC connector portion and a female BNC connector portion, the BNC electrical connector assembly being used to transmit a primary electrical signal, said supplemental electrical connector assembly, comprising:

a pin block having a front end and a rear end, said pin block being mounted to the male BNC connector portion of the BNC electrical connector assembly; and a pogo pin assembly having a proximal end and a distal end, said pogo pin assembly having a connector pin positioned at the proximal end and a contact pin positioned at the distal end, said pogo pin assembly being mounted to said pin block so that the contact pin extends from the front end of said pin block and so that the connector pin extends from the rear end of said pin block, whereby the contact pin makes electrical contact with a supplemental contact pad mounted at a position adjacent the female BNC connector portion of said BNC electrical connector assembly when the male BNC connector portion of said BNC electrical connector assembly is engaged with the female BNC connector portion of said BNC electrical connector assembly.

20. An electrical connector assembly, comprising:

a male BNC connector portion;

a female BNC connector portion adapted to receive said male BNC connector portion, said male and female BNC connector portions comprising a BNC electrical connector assembly for transmitting a primary electrical signal;

a housing adapted to receive said male BNC connector portion of said BNC electrical connector assembly;

a pin block having a front end and a rear end, said pin block being mounted within said housing;

a pogo pin assembly having a proximal end and a distal end, said pogo pin assembly having a connector pin positioned at the proximal end and a contact pin positioned at the distal end, said pogo pin assembly being mounted to said pin block so that the contact pin extends from the front end of said pin block and so that the connector pin extends from the rear end of said pin block; and a supplemental contact pad positioned adjacent said female BNC connector portion of said BNC electrical connector assembly so that the contact pin makes electrical contact with the supplemental contact pad when said male BNC connector portion of said BNC electrical connector assembly is engaged with said female BNC connector portion of said BNC electrical connector assembly.

* * * * *